US007272551B2

(12) United States Patent
Sorin

(10) Patent No.: US 7,272,551 B2
(45) Date of Patent: Sep. 18, 2007

(54) COMPUTATIONAL EFFECTIVENESS ENHANCEMENT OF FREQUENCY DOMAIN PITCH ESTIMATORS

(75) Inventor: Alexander Sorin, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 849 days.

(21) Appl. No.: 10/373,260

(22) Filed: Feb. 24, 2003

(65) Prior Publication Data

US 2004/0167775 A1 Aug. 26, 2004

(51) Int. Cl.
*G10L 19/14* (2006.01)

(52) U.S. Cl. ..... 704/205; 704/207; 704/208

(58) Field of Classification Search ..... 704/205, 704/207, 208

See application file for complete search history.

(56) References Cited

U.S. PATENT DOCUMENTS 4,384,335 A * 5/1983 Duifhuis et al. ..... 704/207
4,791,671 A * 12/1988 Willems ..... 704/217
6,587,816 B1 7/2003 Chazen et al.
6,876,953 B1 * 4/2005 Fisher ..... 702/189
2003/0125934 A1 * 7/2003 Chen et al. ..... 704/207
2003/0171917 A1 * 9/2003 Zhu et al. ..... 704/207

* cited by examiner

*Primary Examiner*—David Hudspeth

(57) ABSTRACT

Estimating a speech signal pitch frequency by determining a speech signal frame line spectrum including spectral lines having respective line amplitudes and frequencies, selecting a predefined number of spectral lines having highest amplitudes, fewer then the total number of the spectral lines, calculating a preliminary utility function over a pitch frequency range to provide a preliminary utility function value for each pitch frequency in the range measuring the compatibility of the selected spectral lines with the pitch frequency, identifying a predefined number of preliminary pitch frequency candidates at least partly responsive to the preliminary utility function, where each candidate is a local maximum of the preliminary utility function, calculating a final utility score for each of the candidates, and selecting any of the candidates to be an estimated pitch frequency of the speech signal at least partly responsive to any of the final utility scores.

31 Claims, 13 Drawing Sheets

COMPUTATIONAL EFFECTIVENESS ENHANCEMENT OF FREQUENCY DOMAIN PITCH ESTIMATORS

FIELD OF THE INVENTION

The present invention relates generally to methods and apparatus for processing of audio signals, and specifically to methods for estimating the pitch of a speech signal.

BACKGROUND OF THE INVENTION

Speech sounds are produced by modulating air flow in the speech tract. Voiceless sounds originate from turbulent noise created at a constriction somewhere in the vocal tract, while voiced sounds are excited in the larynx by periodic vibrations of the vocal cords. Roughly speaking, the variable period of the laryngeal vibrations gives rise to the pitch of the speech sounds. Low-bit-rate speech coding schemes typically separate the modulation from the speech source (voiced or unvoiced), and code these two elements separately. In order to enable the speech to be properly reconstructed, it is necessary to accurately estimate the pitch of the voiced parts of the speech at the time of coding. A variety of techniques have been developed for this purpose, including both time- and frequency-domain methods.

The Fourier transform of a periodic signal, such as voiced speech, has the form of a train of impulses, or peaks, in the frequency domain. This impulse train corresponds to the line spectrum of the signal, which can be represented as a sequence $\{(a_i, \theta_i)\}$, wherein $\theta_i$ are the frequencies of the peaks, and $a_i$ are the respective complex-valued line spectral amplitudes. To determine whether a given segment of a speech signal is voiced or unvoiced, and to calculate the pitch if the segment is voiced, the time-domain signal is first multiplied by a finite smooth window. The Fourier transform of the windowed signal is then given by:

$$X(\theta) = \sum_k a_k W(\theta - \theta_k) \qquad \text{EQ. 1}$$

wherein $W(\theta)$ is the Fourier transform of the window.

Given any pitch frequency, the line spectrum corresponding to that pitch frequency could contain line spectral components at all multiples of that frequency. It therefore follows that any frequency appearing in the line spectrum may be a multiple of a number of different candidate pitch frequencies. Consequently, for any peak appearing in the transformed signal, there will be a sequence of candidate pitch frequencies that could give rise to that particular peak, wherein each of the candidate frequencies is an integer dividend of the frequency of the peak. This ambiguity is present whether the spectrum is analyzed in the frequency domain, or whether it is transformed back to the time domain for further analysis.

Frequency-domain pitch estimation is typically based on analyzing the locations and amplitudes of the peaks in the transformed signal $X(\theta)$, such as by correlating the spectrum with the "teeth" of a prototypical spectral "comb." The pitch frequency is given by the comb frequency that maximizes the correlation of the comb function with the transformed speech signal.

A related class of schemes for pitch estimation are known as "cepstral" schemes, where a log operation is applied to the frequency spectrum of the speech signal, and the log spectrum is then transformed back to the time domain to generate the cepstral signal. The pitch frequency is the location of the first peak of the time-domain cepstral signal. This corresponds precisely to maximizing over the period T, the correlation of the log of the amplitudes corresponding to the line frequencies z(i) with $\cos(\omega(i)T)$. For each guess of the pitch period T, the function $\cos(\omega T)$ is a periodic function of $\omega$. It has peaks at frequencies corresponding to multiples of the pitch frequency 1/T. If those peaks happen to coincide with the line frequencies, then 1/T is a good candidate to be the pitch frequency, or some multiple thereof.

A common method for time-domain pitch estimation uses correlation-type schemes, which search for a pitch period T that maximizes the cross-correlation of a signal segment centered at time t and one centered at time t−T. The pitch frequency is the inverse of T.

Both time- and frequency-domain methods of pitch determination are subject to instability and error, and accurate pitch determination is therefore computationally intensive. In time domain analysis, for example, a high-frequency component in the line spectrum results in the addition of an oscillatory term in the cross-correlation. This term varies rapidly with the estimated pitch period T when the frequency of the component is high. In such a case, even a slight deviation of T from the true pitch period will reduce the value of the cross-correlation substantially and may lead to rejection of a correct estimate. A high-frequency component will also add a large number of peaks to the cross-correlation, which complicate the search for the true maximum. In the frequency domain, a small error in the estimation of a candidate pitch frequency will result in a major deviation in the estimated value of any spectral component that is a large integer multiple of the candidate frequency.

With currently known techniques, an exhaustive search with high resolution must be made over all possible candidates and their multiples in order to avoid missing the best candidate pitch for a given input spectrum. It is often necessary, dependent on the actual pitch frequency, to search the sampled spectrum up to high frequencies, such as above 1500 Hz. At the same time, the analysis interval, or window, must be long enough in time to capture at least several cycles of every conceivable pitch candidate in the spectrum, resulting in an additional increase in complexity. Analogously, in the time domain, the optimal pitch period T must be searched for over a wide range of times and with high resolution. The search in either case consumes substantial computing resources. The search criteria cannot be relaxed even during intervals that may be unvoiced, since an interval can be judged unvoiced only after all candidate pitch frequencies or periods have been ruled out. Although pitch values from previous frames are commonly used in guiding the search for the current value, the search cannot be limited to the neighborhood of the previous pitch. Otherwise, errors in one interval will be perpetuated in subsequent intervals, and voiced segments may be confused for unvoiced.

SUMMARY OF THE INVENTION

It is an object of the present invention to provide improved methods and apparatus for determining the pitch of an audio signal, and particularly of a speech signal.

In one aspect of the present invention, a method for estimating a pitch frequency of a speech signal is provided, including finding a line spectrum of the signal, the spectrum including spectral lines having respective line amplitudes and line frequencies, computing a utility function which is indicative, for each candidate pitch frequency in a given pitch frequency range, of a compatibility of the spectrum with the candidate pitch frequency, and estimating the pitch frequency of the speech signal responsive to the utility function.

In another aspect of the present invention, computing the utility function includes computing at least one influence function that is periodic in a ratio of the frequency of one of the spectral lines to the candidate pitch frequency. Computing the at least one influence function also preferably includes computing a function of the ratio having maxima at integer values of the ratio and minima therebetween. Computing the function of the ratio also preferably includes computing values of a piecewise linear function c(f), having a maximum value in a first interval surrounding f=0, a minimum value in a second interval surrounding f=½, and a value that varies linearly in a transition interval between the first and second intervals.

In another aspect of the present invention, computing the at least one influence function includes computing respective influence functions for multiple lines in the spectrum, and computing the utility function includes computing a superposition of the influence functions. Preferably, the respective influence functions include piecewise linear functions having break points, and computing the superposition includes calculating values of the influence functions at the break points, such that the utility function is determined by interpolation between the break points. Computing the respective influence functions also preferably includes computing at least first and second influence functions for first and second lines in the spectrum in succession, and computing the utility function includes computing a partial utility function including the first influence function and then adding the second influence function to the partial utility function by calculating the values of the second influence function at the break points of the partial utility function and calculating the values of the partial utility function at the break points of the second influence function.

In another aspect of the present invention, a method for estimating a pitch frequency of a speech signal is provided, including determining a line spectrum of a frame of a speech signal, the spectrum including a plurality of spectral lines having respective line amplitudes and line frequencies, selecting a predefined number of the spectral lines having the highest amplitudes among the spectral lines, where the number of selected spectral lines is less then the total number of the plurality of spectral lines, calculating a preliminary utility function over a pitch frequency range, thereby providing a preliminary utility function value for each pitch frequency in the range that is a measure of a compatibility of the selected spectral lines with the pitch frequency, identifying a predefined number of preliminary pitch frequency candidates at least partly responsive to the preliminary utility function, where each preliminary pitch frequency candidate is a local maximum of the preliminary utility function, calculating a final utility score for each of the preliminary pitch frequency candidates, and selecting any of the plurality of preliminary pitch frequency candidates to be an estimated pitch frequency of the speech signal at least partly responsive to any of the final utility scores.

In another aspect of the present invention the calculating a preliminary utility function step includes computing an influence function respective to each of the selected spectral lines, where the influence function is periodic in a ratio of the frequency of the spectral line to any pitch frequency, and computing a superposition of the influence functions.

In another aspect of the present invention the computing an influence function step includes computing a function of the ratio having maxima at integer values of the ratio and minima therebetween.

In another aspect of the present invention the computing an influence function step includes computing values of a piecewise linear function c(f), having a maximum value in a first interval surrounding f=0, a minimum value in a second interval surrounding f=½, and a value that varies piecewise linearly in a transition interval between the first and second intervals.

In another aspect of the present invention the influence functions are piecewise linear functions, and where the computing a superposition step includes calculating values of the influence functions at their break points such that the preliminary utility function is determined by interpolation between the break points.

In another aspect of the present invention the computing the influence function step includes computing at least first and second influence functions for first and second spectral lines from among the selected spectral lines in succession, and where the computing a preliminary utility function step includes computing a partial utility function including the first influence function, and adding the second influence function to the preliminary utility function by calculating the values of the second influence function at the break points of the preliminary utility function and calculating the values of the preliminary utility function at the break points of the second influence function.

In another aspect of the present invention the determining a pitch frequency candidate step includes preferentially selecting a local maximum of the preliminary utility function that is near in frequency to a previously-estimated pitch frequency of a preceding frame of the speech signal.

In another aspect of the present invention the calculating a final utility score step includes computing an influence function respective to each of the spectral lines, where the influence function is periodic in a ratio of the frequency of the spectral line to any pitch frequency, and computing a sum of the influence functions.

In another aspect of the present invention the computing an influence function step includes computing a function of the ratio having maxima at integer values of the ratio and minima therebetween.

In another aspect of the present invention the computing the function of the ratio step includes computing values of a piecewise linear function c(f), having a maximum value in a first interval surrounding f=0, a minimum value in a second interval surrounding f=½, and a value that varies piecewise linearly in a transition interval between the first and second intervals.

In another aspect of the present invention the selecting a pitch frequency step includes preferentially selecting one of the preliminary pitch frequency candidates that has a higher final utility score than another one of the preliminary pitch frequency candidates.

In another aspect of the present invention the selecting a pitch frequency step includes preferentially selecting one of the preliminary pitch frequency candidates that has a higher frequency than another one of the preliminary pitch frequency candidates.

In another aspect of the present invention the selecting a pitch frequency step includes preferentially selecting one of the preliminary pitch frequency candidates that is near in frequency to a previously-estimated pitch frequency of a preceding frame of the speech signal.

In another aspect of the present invention the method further includes determining whether the speech signal is voiced or unvoiced by comparing the final utility score of the estimated pitch frequency to a predetermined threshold.

In another aspect of the present invention the method further includes encoding the speech signal responsive to the estimated pitch frequency.

In another aspect of the present invention apparatus is provided for estimating a pitch frequency of a speech signal, including means for determining a line spectrum of a frame of a speech signal, the spectrum including a plurality of spectral lines having respective line amplitudes and line frequencies, means for selecting a predefined number of the spectral lines having the highest amplitudes among the spectral lines, where the number of selected spectral lines is less then the total number of the plurality of spectral lines, means for calculating a preliminary utility function over a pitch frequency range, thereby providing a preliminary utility function value for each pitch frequency in the range that is a measure of a compatibility of the selected spectral lines with the pitch frequency, means for identifying a predefined number of preliminary pitch frequency candidates at least partly responsive to the preliminary utility function, where each preliminary pitch frequency candidate is a local maximum of the preliminary utility function, means for calculating a final utility score for each of the preliminary pitch frequency candidates, and means for selecting any of the plurality of preliminary pitch frequency candidates to be an estimated pitch frequency of the speech signal at least partly responsive to any of the final utility scores.

In another aspect of the present invention the means for calculating a preliminary utility function is operative to compute an influence function respective to each of the selected spectral lines, where the influence function is periodic in a ratio of the frequency of the spectral line to any pitch frequency, and compute a superposition of the influence functions.

In another aspect of the present invention the means for computing an influence function is operative to compute a function of the ratio having maxima at integer values of the ratio and minima therebetween.

In another aspect of the present invention the means for computing an influence function is operative to compute values of a piecewise linear function c(f), having a maximum value in a first interval surrounding f=0, a minimum value in a second interval surrounding f=½, and a value that varies piecewise linearly in a transition interval between the first and second intervals.

In another aspect of the present invention the influence functions are piecewise linear functions, and where the means for computing a superposition is operative to calculating values of the influence functions at their break points such that the preliminary utility function is determined by interpolation between the break points.

In another aspect of the present invention the means for computing the influence function is operative to compute at least first and second influence functions for first and second spectral lines from among the selected spectral lines in succession, and where the means for computing a preliminary utility function is operative to compute a partial utility function including the first influence function, and add the second influence function to the preliminary utility function by calculating the values of the second influence function at the break points of the preliminary utility function and calculating the values of the preliminary utility function at the break points of the second influence function.

In another aspect of the present invention the means for determining a pitch frequency candidate is operative to preferentially select a local maximum of the preliminary utility function that is near in frequency to a previously-estimated pitch frequency of a preceding frame of the speech signal.

In another aspect of the present invention the means for calculating a final utility score is operative to compute an influence function respective to each of the spectral lines, where the influence function is periodic in a ratio of the frequency of the spectral line to any pitch frequency, and compute a sum of the influence functions.

In another aspect of the present invention the means for computing an influence function is operative to compute a function of the ratio having maxima at integer values of the ratio and minima therebetween.

In another aspect of the present invention the means for computing the function of the ratio is operative to compute values of a piecewise linear function c(f), having a maximum value in a first interval surrounding f=0, a minimum value in a second interval surrounding f=½, and a value that varies piecewise linearly in a transition interval between the first and second intervals.

In another aspect of the present invention the means for selecting a pitch frequency is operative to preferentially select one of the preliminary pitch frequency candidates that has a higher final utility score than another one of the preliminary pitch frequency candidates.

In another aspect of the present invention the means for selecting a pitch frequency is operative to preferentially select one of the preliminary pitch frequency candidates that has a higher frequency than another one of the preliminary pitch frequency candidates.

In another aspect of the present invention the means for selecting a pitch frequency is operative to preferentially select one of the preliminary pitch frequency candidates that is near in frequency to a previously-estimated pitch frequency of a preceding frame of the speech signal.

In another aspect of the present invention the apparatus and further includes means for determining whether the speech signal is voiced or unvoiced by comparing the final utility score of the estimated pitch frequency to a predetermined threshold.

In another aspect of the present invention the apparatus and further includes means for encoding the speech signal responsive to the estimated pitch frequency.

In another aspect of the present invention a computer program embodied on a computer-readable medium is provided, the computer program including a first code segment operative to determine a line spectrum of a frame of a speech signal, the spectrum including a plurality of spectral lines having respective line amplitudes and line frequencies, a second code segment operative to select a predefined number of the spectral lines having the highest amplitudes among the spectral lines, where the number of selected spectral lines is less then the total number of the plurality of spectral lines, a third code segment operative to calculate a preliminary utility function over a pitch frequency range, thereby providing a preliminary utility function value for each pitch frequency in the range that is a measure of a compatibility of the selected spectral lines with the pitch frequency, a fourth code segment operative to identify a predefined number of preliminary pitch frequency candidates at least partly responsive to the preliminary utility function, where each preliminary pitch frequency candidate is a local maximum of the preliminary utility function, a fifth code segment operative to calculate a final utility score for each of the preliminary pitch frequency candidates, and a sixth code segment operative to select any of the plurality of preliminary pitch frequency candidates to be an estimated pitch frequency of the speech signal at least partly responsive to any of the final utility scores.

BRIEF DESCRIPTION OF THE DRAWINGS

The present invention will be more fully understood from the following detailed description of the preferred embodiments thereof, taken together with the drawings in which.

DETAILED DESCRIPTION OF PREFERRED EMBODIMENTS

Figure 1:
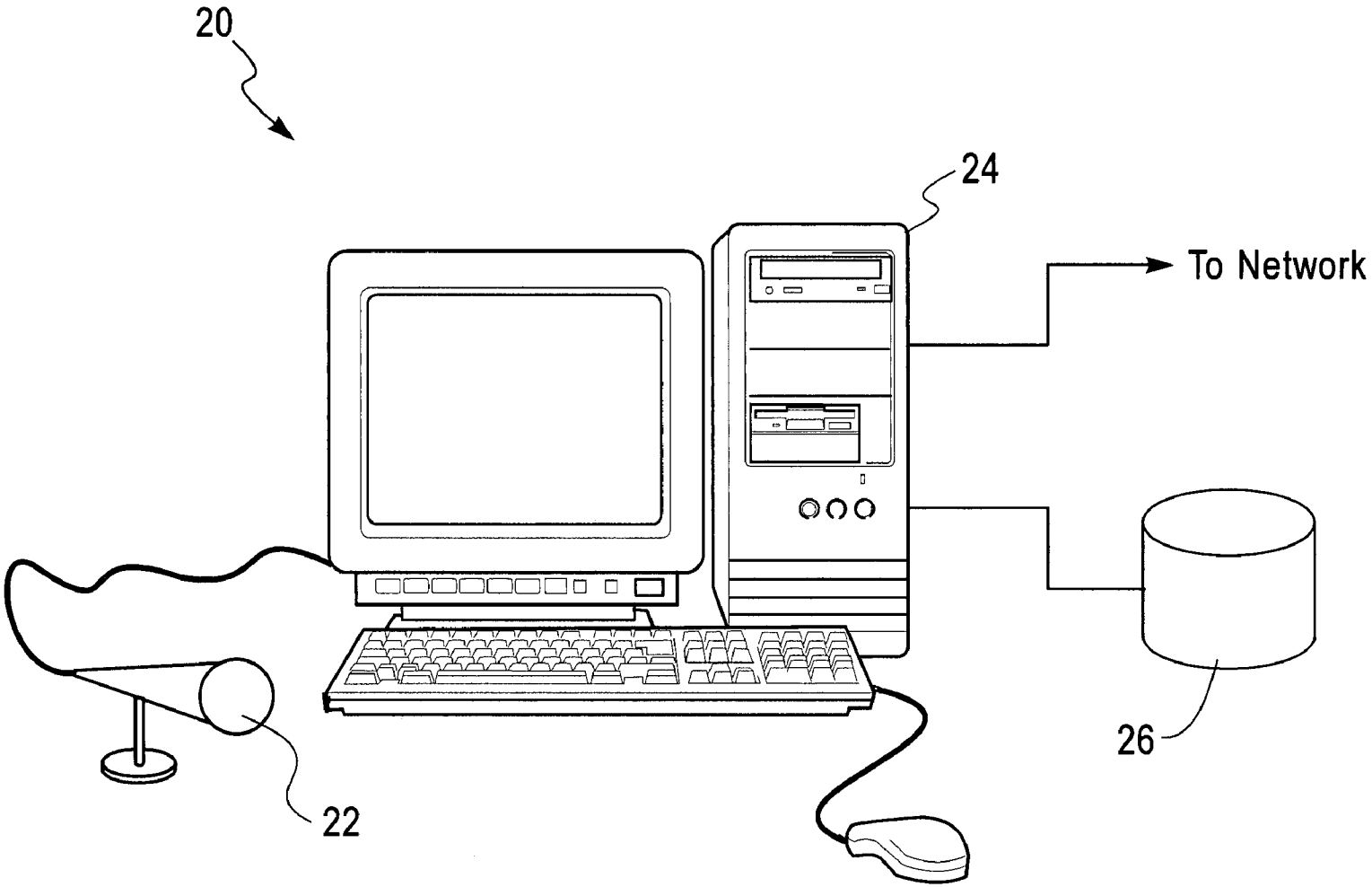
FIG. 1 is a schematic, pictorial illustration of a system for speech analysis and encoding, in accordance with a preferred embodiment of the present invention.

FIG. 1 is a schematic, pictorial illustration of a system 20 for analysis and encoding of speech signals, in accordance with a preferred embodiment of the present invention. The system comprises an audio input device 22, such as a microphone, which is coupled to an audio processor 24. Alternatively, the audio input to the processor may be provided over a communication line or recalled from a storage device, in either analog or digital form. Processor 24 preferably comprises a general-purpose computer programmed with suitable software for carrying out the functions described hereinbelow. The software may be provided to the processor in electronic form, for example, over a network, or it may be furnished on tangible media, such as CD-ROM or non-volatile memory. Alternatively or additionally, processor 24 may comprise a digital signal processor (DSP) or hard-wired logic.

Figure 2:
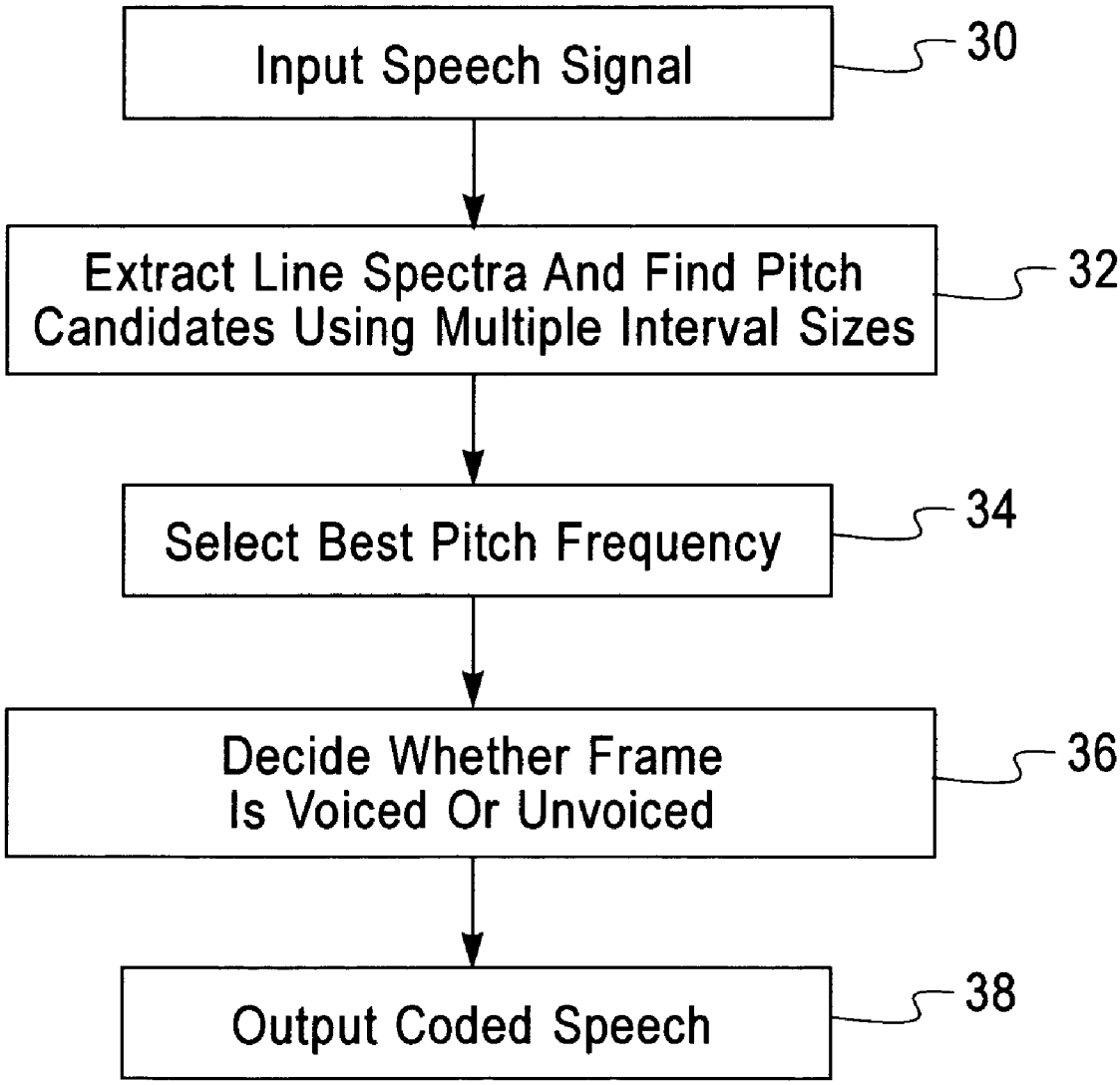
FIG. 2 is a flow chart that schematically illustrates a method for pitch determination and speech encoding, in accordance with a preferred embodiment of the present invention.

FIG. 2 is a flow chart that schematically illustrates a method for processing speech signals using system 20, in accordance with a preferred embodiment of the present invention. At an input step 30, a speech signal is input from device 22 or from another source and is digitized for further processing (if the signal is not already in digital form). The digitized signal is divided into frames of appropriate duration and relative offset, typically 25 ms and 10 ms respectively, for subsequent processing. At a pitch identification step 32, processor 24 extracts an approximate line spectrum of the signal for each frame. The spectrum is extracted by analyzing the signal over multiple time intervals simultaneously, as described hereinbelow. Preferably, two intervals are used for each frame: a short interval for extraction of high-frequency pitch values, and a long interval for extraction of low-frequency values. Alternatively, a greater number of intervals may be used. The low- and high-frequency portions together preferably cover the entire range of possible pitch values. Based on the extracted spectra, candidate pitch frequencies for the current frame are identified.

The best estimate of the pitch frequency for the current frame is selected from among the candidate frequencies in all portions of the spectrum, at a pitch selection step 34. Based on the selected pitch, system 24 determines whether the current frame is actually voiced or unvoiced, at a voicing decision step 36. At an output coding step 38, the voiced/unvoiced decision and the selected pitch frequency are used in encoding the current frame. Any suitable encoding method may be used, such as the methods described in U.S. patent applications Ser. Nos. 09/410,085 and 09/432,081. Preferably, the coded output includes features of the modulation of the stream of sounds along with the voicing and pitch information. The coded output is typically transmitted over a communication link and/or stored in a memory 26 (FIG. 1). The methods for pitch determination described herein may also be used in other audio processing applications, with or without subsequent encoding.

Figure 3:
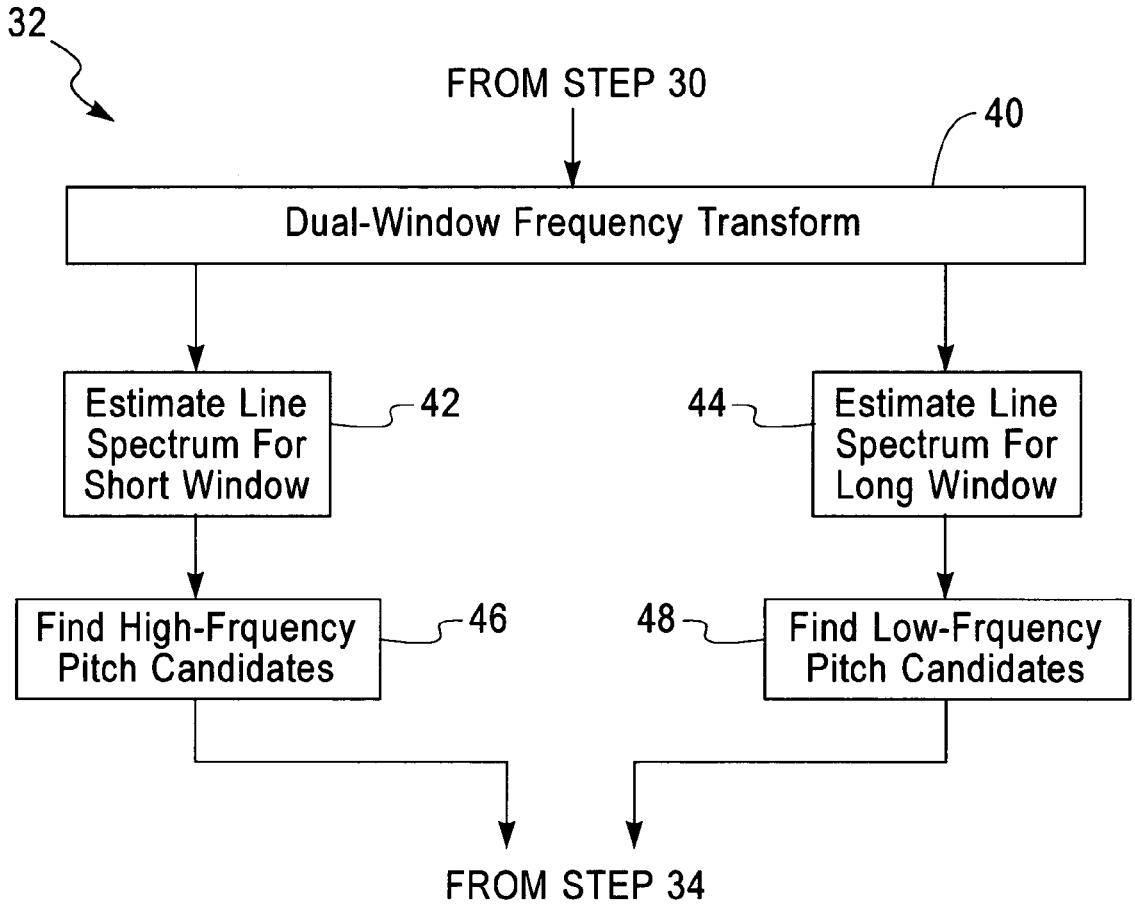
FIG. 3 is a flow chart that schematically illustrates a method for extracting line spectra and finding candidate pitch values for a speech signal, in accordance with a preferred embodiment of the present invention.

FIG. 3 is a flow chart that schematically illustrates details of pitch identification step 32, in accordance with a preferred embodiment of the present invention. At a transform step 40, a dual-window short-time Fourier transform (STFT) is applied to each frame of the speech signal. The range of possible pitch frequencies for speech signals is typically from 55 to 420 Hz. This range is preferably divided into two regions: a lower region from 55 Hz up to a middle frequency $F_b$ (typically about 90 Hz), and an upper region from $F_b$ up to 420 Hz. As described hereinbelow, for each frame a short time window is defined for searching the upper frequency region, and a long time window is defined for the lower frequency region. Alternatively, a greater number of adjoining windows may be used. The STFT is applied to each of the time windows to calculate respective high- and low-frequency spectra of the speech signal.

Processing of the short- and long-window spectra preferably proceeds on separate, parallel tracks. At spectrum estimation steps 42 and 44, high- and low-frequency line spectra, having the form $\{(a_i, \theta_i)\}$, defined above, are derived from the respective STFT results. The line spectra are used at candidate frequency finding steps 46 and 48 to find respective sets of high- and low-frequency candidate values of the pitch. The pitch candidates are fed to step 34 (FIG. 2) for selection of the best pitch frequency estimate among the candidates. Details of steps 40 through 48 are described hereinbelow with reference to FIGS. 4, 5 and 6A-6D.

Figure 4:
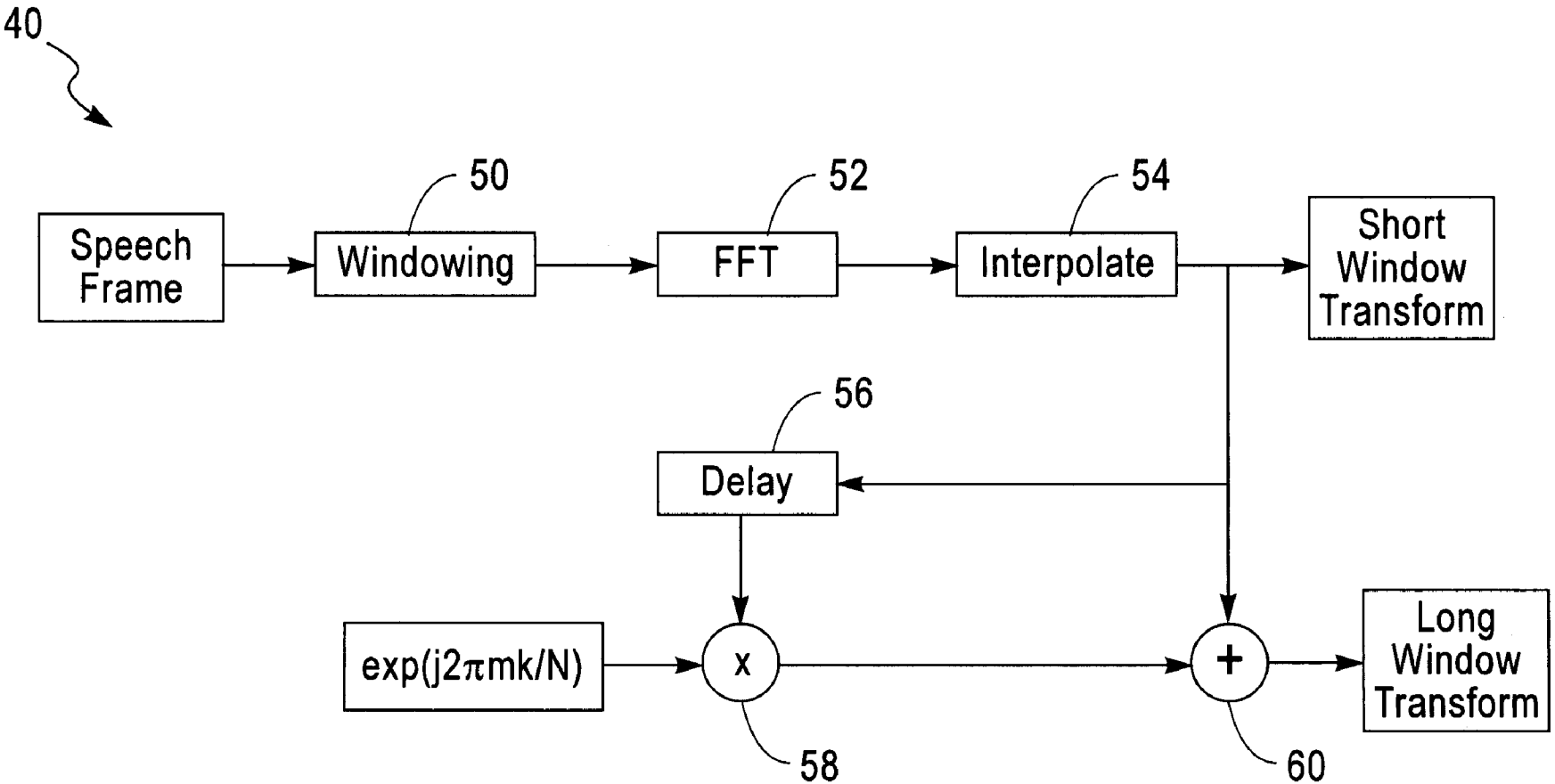
FIG. 4 is a block diagram that schematically illustrates a method for extraction of line spectra over long and short time intervals simultaneously, in accordance with a preferred embodiment of the present invention.

FIG. 4 is a block diagram that schematically illustrates details of transform step 40, in accordance with a preferred embodiment of the present invention. A windowing block 50 applies a windowing function, preferably a Hamming window 25 ms in duration, as is known in the art, to the current frame of the speech signal. A transform block 52 applies a suitable frequency transform to the windowed frame, preferably a Fast Fourier Transform (FFT) with a resolution of 256 or 512 frequency points, dependent on the sampling rate.

Preferably, the output of block 52 is fed to an interpolation block 54, which is used to increase the resolution of the spectrum, such as by applying a Dirichlet kernel $$D(\theta, N) = \frac{\sin(N\theta/2)}{\sin(\theta/2)}$$

to the FFT output coefficients $X^d[k]$, giving interpolated spectral coefficients:

$$X(\theta) = \sum_{k=0}^{N-1} \frac{1}{N} X^d[k] D(\theta - 2\pi k/N, N) \exp\{-j(\theta - 2\pi k/N)(N-1)/2\} \quad \text{EQ. 2}$$

For efficient interpolation, a small number of coefficients $X^d[k]$ are preferably used in a near vicinity of each frequency θ. Typically, 16 coefficients are used, and the resolution of the spectrum is increased in this manner by a factor of two, so that the number of points in the interpolated spectrum is L=2N. The output of block 54 gives the short window transform, which is passed to step 42 (FIG. 3).

The long window transform to be passed to step 44 is calculated by combining the short window transforms of the current frame, $X^s$, and of the previous frame, $Y^s$, which is held by a delay block 56. Before combining, the coefficients from the previous frame are multiplied by a phase shift of 2πmk/L, at a multiplier 58, wherein m is the number of samples in a frame. The long-window spectrum $X^1$ is generated by adding the short-window coefficients from the current and previous frames (with appropriate phase shift) at an adder 60, giving:

$$X^1(2\pi k/L) = X^s(2\pi k/L) + Y^s(2\pi k/L)\exp(j2\pi mk/L) \quad \text{EQ. 3}$$

Here k is an integer taken from a set of integers such that the frequencies 2πk/L span the full range of frequencies. The method exemplified by FIG. 4 thus allows spectra to be derived for multiple, overlapping windows with little more computational effort that is required to perform a STFT operation on a single window.

Figure 5:
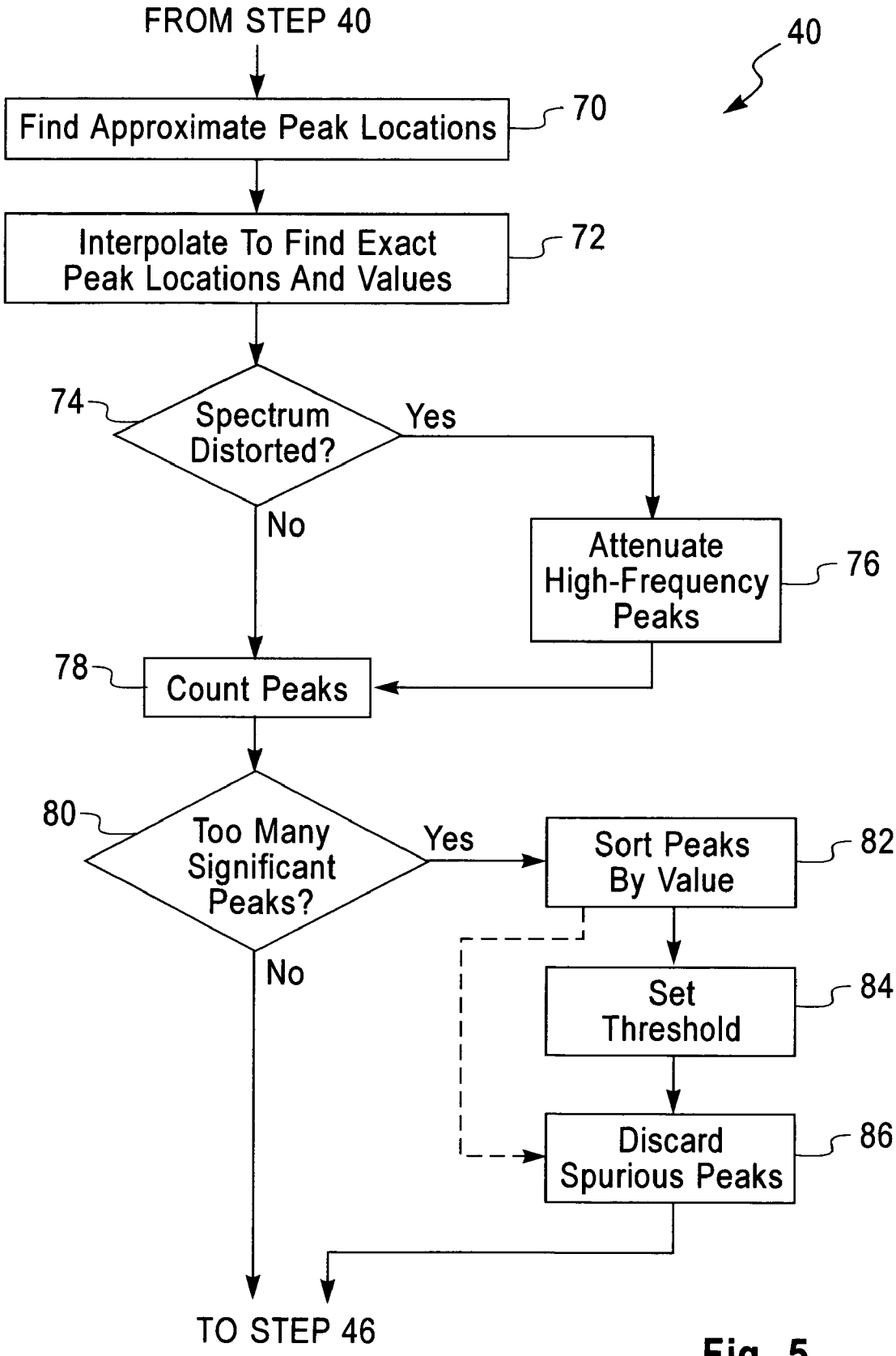
FIG. 5 is a flow chart that schematically illustrates a method for finding peaks in a line spectrum, in accordance with a preferred embodiment of the present invention.

FIG. 5 is a flow chart that schematically shows details of line spectrum estimation steps 42 and 44, in accordance with a preferred embodiment of the present invention. The method of line spectrum estimation illustrated in this figure is applied to both the long- and short-window transforms X(θ) generated at step 40. The object of steps 42 and 44 is to determine an estimate $\{(\mathbf{81}\ |\hat{a}_i|, \hat{\theta}_i)\}$, of the absolute line spectrum of the current frame. The sequence of peak frequencies $\{\hat{\theta}_i\}$ is derived from the locations of the local maxima of X(θ), and $|\hat{a}_i| = |X(\hat{\theta}_i)|$. The estimate is based on the assumption that the width of the main lobe of the transform of the windowing function (block 50) in the frequency domain is small compared to the pitch frequency. Therefore, the interaction between adjacent windows in the spectrum is small.

Estimation of the line spectrum begins with finding approximate frequencies of the peaks in the interpolated spectrum (per equation (2)), at a peak finding step 70. Typically, these frequencies are computed with integer precision. At an interpolation step 72, the peak frequencies and amplitudes are calculated to floating point precision, preferably using quadratic interpolation based on the spectrum amplitudes at the three nearest neighboring integer multiples of 2π/L.

At a distortion evaluation step 74, the array of peaks found in the preceding steps is processed to assess whether distortion was present in the input speech signal and, if so, to attempt to correct the distortion. Preferably, the analyzed frequency range is divided into three equal regions, and for each region, the maximum of all amplitudes in the region is computed. The regions completely cover the frequency range. If the maximum value in either the middle- or the high-frequency range is too high compared to that in the low-frequency range, the values of the peaks in the middle and/or high range are attenuated, at an attenuation step 76. It has been found heuristically that attenuation should be applied if the maximum value for the middle-frequency range is more than 65% of that in the low-frequency range, or if the maximum in the high-frequency range is more than 45% of that in the low-frequency range. Attenuating the peaks in this manner "restores" the spectrum to a more likely shape. Generally speaking, if the speech signal was not distorted initially, step 74 will not change its spectrum.

The number of peaks found at step 72 is counted, at a peak counting step 78. At a significant-peak evaluation step 80, the number of peaks is compared to a predetermined maximum number, which is typically set to seven. If seven or fewer peaks are found, the process proceeds directly to step 46 or 48. Otherwise, the peaks are sorted in descending order of their amplitude values, at a sorting step 82. Once a predetermined number of the highest peaks have been found (typically equal to the maximum number of peaks used at step 80), a threshold is set equal to a certain fraction of the amplitude value of the lowest peak in this group of the highest peaks, at a threshold setting step 84. Peaks below this threshold are discarded, at a spurious peak discarding step 86. Alternatively, if at some stage of sorting step 82, the sum of the sorted peak values exceeds a predetermined fraction, typically 95%, of the total sum of the values of all of the peaks that were found, the sorting process stops. All of the remaining, smaller peaks are then discarded at step 86. The purpose of this step is to eliminate small, spurious peaks that may subsequently interfere with pitch determination or with the voiced/unvoiced decision at steps 34 and 36 (FIG. 2).

Figure 6A:
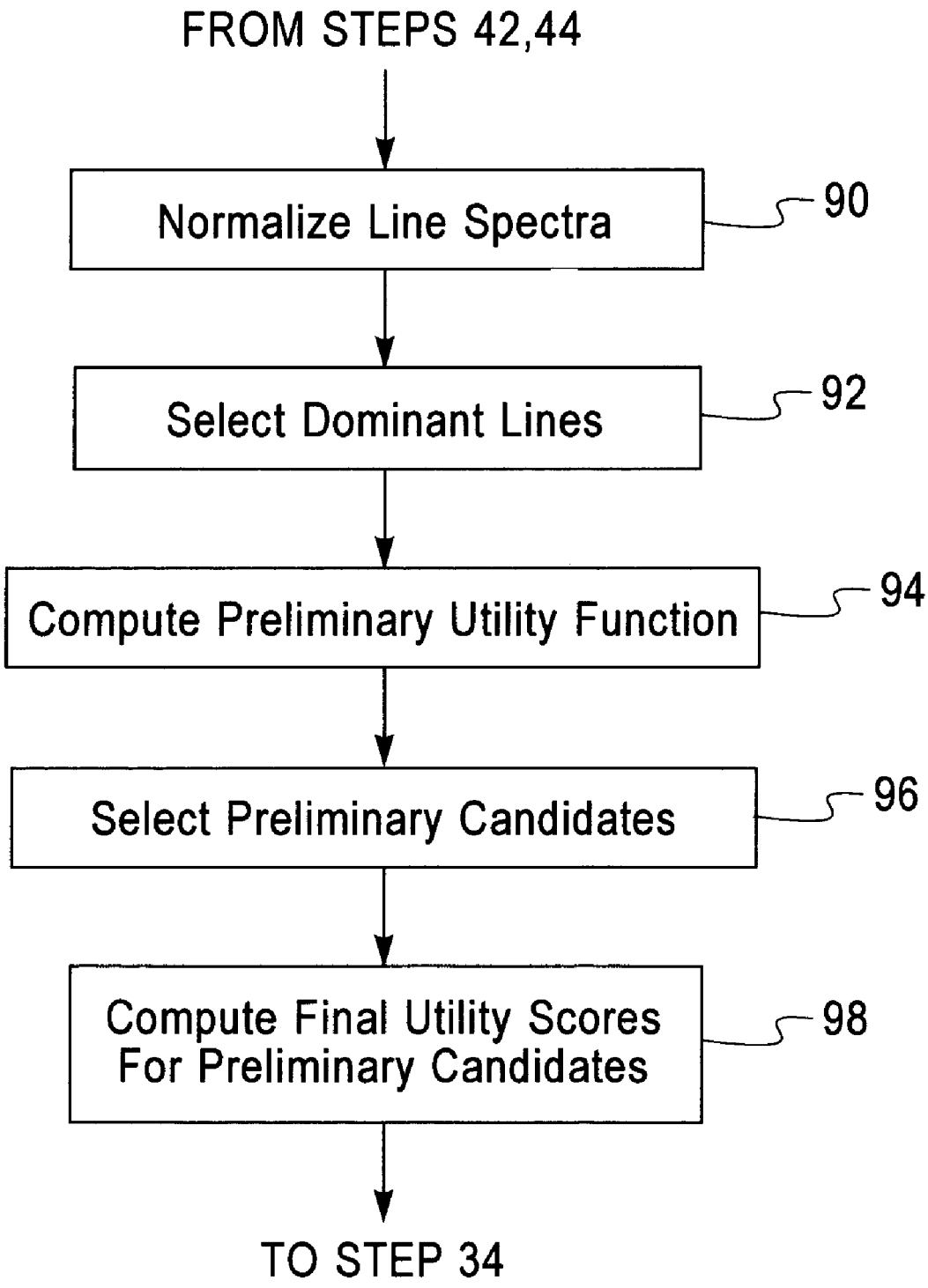
FIGS. 6A, 6B, 6C, and 6D are flow charts that schematically illustrate a method for evaluating candidate pitch frequencies based on an input line spectrum, in accordance with a preferred embodiment of the present invention.

FIG. 6A is a flow chart that schematically shows details of candidate pitch frequency finding steps 46 and 48 (FIG. 3), in accordance with a preferred embodiment of the present invention. These steps are applied respectively to the short- and long-window line spectra $\{(|\hat{a}_i|, \hat{\theta}_i)\}$ output by steps 42 and 44, as shown and described above. In step 46, pitch candidates whose frequencies are higher than a certain threshold are generated, and their utility functions are computed using the procedure outlined below based on the line spectrum generated in the short analysis interval. In step 48, the line spectrum generated in the long analysis interval also generates a pitch candidate list and computes utility functions only for pitch candidates whose frequency is lower than that threshold. For both the long and short windows, the line spectra are normalized, at a normalization step 90, to yield lines with normalized amplitudes $b_i$ and frequencies $f_i$ given by:

$$b_i = \frac{|\hat{a}_i|}{\sum_{k=1}^{K} |\hat{a}_k|} \quad \text{EQ. 4}$$

$$f_i = \frac{\hat{\theta}_i}{2\pi T_S} \quad \text{EQ. 5}$$

In both equations 4 and 5, i runs from 1 to K, where K is the number of spectral lines (peaks) and $T_s$ is the sampling interval. In other words, $1/T_s$ is the sampling frequency of the original speech signal, and $f_i$ is thus the frequency in samples per second of the spectral lines.

A predefined number of spectral lines with highest amplitudes values are selected at a select dominant lines step 92. Then at step 94 a preliminary utility function is computed which is indicative, for each candidate pitch frequency in a given pitch frequency range, of a compatibility of the dominant spectral lines selected at step 92 with the candidate pitch frequency. A utility function definition in accordance with a preferred embodiment of the present invention is described in greater detail hereinbelow with reference to FIG. 7 and FIG. 8, while a preferred method of calculating the preliminary utility function is described in greater detail hereinbelow with reference to FIG. 6B. A predefined number of pitch frequency candidates are then selected at a select preliminary candidates step 96 using the preliminary utility function. A preferred method of selecting preliminary candidates is described in greater detail hereinbelow with reference to FIG. 6C. A utility score is then calculated for each preliminary candidate at a compute final utility scores for preliminary candidates step 98. A preferred method of computing final utility scores is described in greater detail hereinbelow with reference to FIG. 6D.

Figure 7:
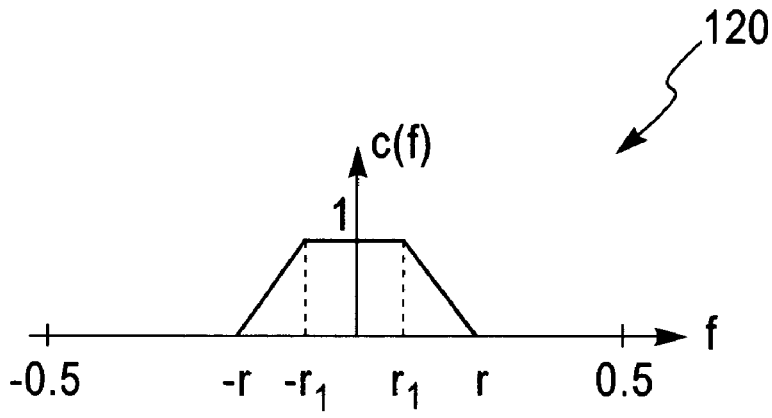
FIG. 7 is a plot of one cycle of an influence function used in evaluating the candidate pitch frequencies in accordance with the method of FIGS. 6A-6D.

In accordance with a preferred embodiment of the present invention the utility function is defined through an influence function, such as is shown in FIG. 7, which is a plot showing one cycle of an influence function 120 identified as c(f). The influence function preferably has the following characteristics:

1. c(f+1)=c(f), i.e., the function is periodic, with period 1.
2. $0 \leqq c(f) \leqq 1$
3. c(0)=1.
4. c(f)=c(−f).
5. c(f)=0 for $r \leqq |f| \leqq ½$, wherein r is a parameter <½.
6. c(f) piecewise linear and non-increasing in [0, r].

In the preferred embodiment shown in FIG. 7, the influence function is trapezoidal, and its one period cycle has the form:

$$c(f) = \begin{cases} 1 & f \in [-r_1, r_1] \\ 1 - (|f| - r_1)/(r - r_1) & |f| \in [r_1, r] \\ 0 & r < |f| < 0.5 \end{cases} \quad \text{EQ. 6}$$

Alternatively, another periodic function may be used, preferably a piecewise linear function whose value is zero above some predetermined distance from the origin.

Figure 8:
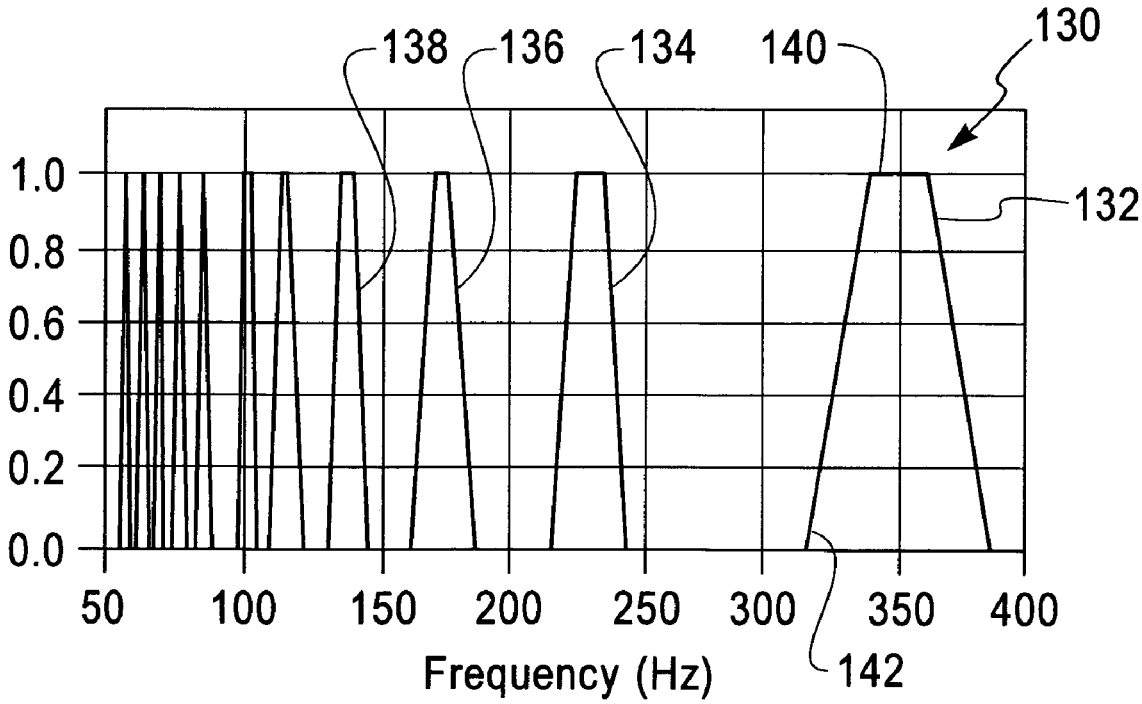
FIG. 8 is a plot of a partial utility function derived by applying the influence function of FIG. 7 to a component of a line spectrum, in accordance with a preferred embodiment of the present invention.

FIG. 8 is a plot showing a component 130 of a utility function $U(f_p)$, which is generated for candidate pitch frequencies $f_p$ using the influence function c(f), in accordance with a preferred embodiment of the present invention. The utility function $U(f_p)$ for any given pitch frequency is generated based on the line spectrum $\{(b_i, f_i)\}$, as given by:

$$U(f_p) = \sum_{i=1}^{K} b_i c(f_1 / f_p) \quad \text{EQ. 7}$$

A component of this function, $U_i(f_p)$, is then defined for a single spectral line $(b_i, f_i)$ as:

$$U_i(f_p) = b_i c(f_i/f_p) \quad \text{EQ. 8}$$

FIG. 8 shows one such component, wherein $f_i$=700 Hz, and the component is evaluated over pitch frequencies in the range from 50 to 400 Hz. The component comprises a plurality of lobes 132, 134, 136, 138, . . . , each defining a region of the frequency range in which a candidate pitch frequency could occur and give rise to the spectral line at $f_i$.

Because the values $b_i$ are normalized, and $c(f) \leqq 1$, the utility function for any given candidate pitch frequency will be between zero and one. Since $c(f_i/f_p)$ is by definition periodic in $f_i$ with period $f_p$, a high value of the utility function for a given pitch frequency $f_p$ indicates that most of the frequencies in the sequence $\{f_i\}$ are close to some multiple of the pitch frequency. Thus, the pitch frequency for the current frame could be found in a straightforward (but inefficient) way by calculating the utility function for all possible pitch frequencies in an appropriate frequency range with a specified resolution, and choosing a candidate pitch frequency with a high utility value.

Returning now to FIG. 6A, a number M of spectral lines $\{(b_{ij}, f_{ij})\}$, j=1, 2, . . . , M associated with M highest amplitudes is selected out of K lines at a dominant lines selection step 92. M is set to seven in a preferred embodiment of the present invention. A preliminary utility function computed at step 94 mentioned above is given by:

$$UD(f_p) = \sum_{j=1}^{M} b_{ij} c(f_{ij} / f_p) \quad \text{EQ. 9}$$

Only the M dominant lines selected at step 92 are used. The preliminary utility function is computed over the full pitch frequency search range by using a fast method described hereinbelow with reference to FIG. 6B. Since the influence function c(f) is piecewise linear, the value of $U_{ij}(f_p)$ at any point is defined by its value at break points of the function (i.e., points of discontinuity in the first derivative), such as points 140 and 142 shown in FIG. 8. Although $U_{ij}(f_p)$ is itself not piecewise linear, it can be approximated as a linear function in all regions. The fast method of $UD(f_p)$ computing uses the breakpoint values of the components $U_{ij}(f_p)$ to build up the full function $UD(f_p)$. Each component $U_{ij}(f_p)$ adds its own breakpoints to the full function, while values of the utility function between the breakpoints may be found by performing linear interpolation.

The process of building up $UD(f_p)$ uses a series of partial utility functions $PU_j$, generated by adding in the components $U_{ij}(f_p)$ for each of the dominant spectral lines $(b_{ij}, f_{ij})$ in succession:

$$PU_j(f_p) = \sum_{k=1}^{j} U_{ik}(f_p) \quad \text{EQ. 10}$$

Figure 6B:
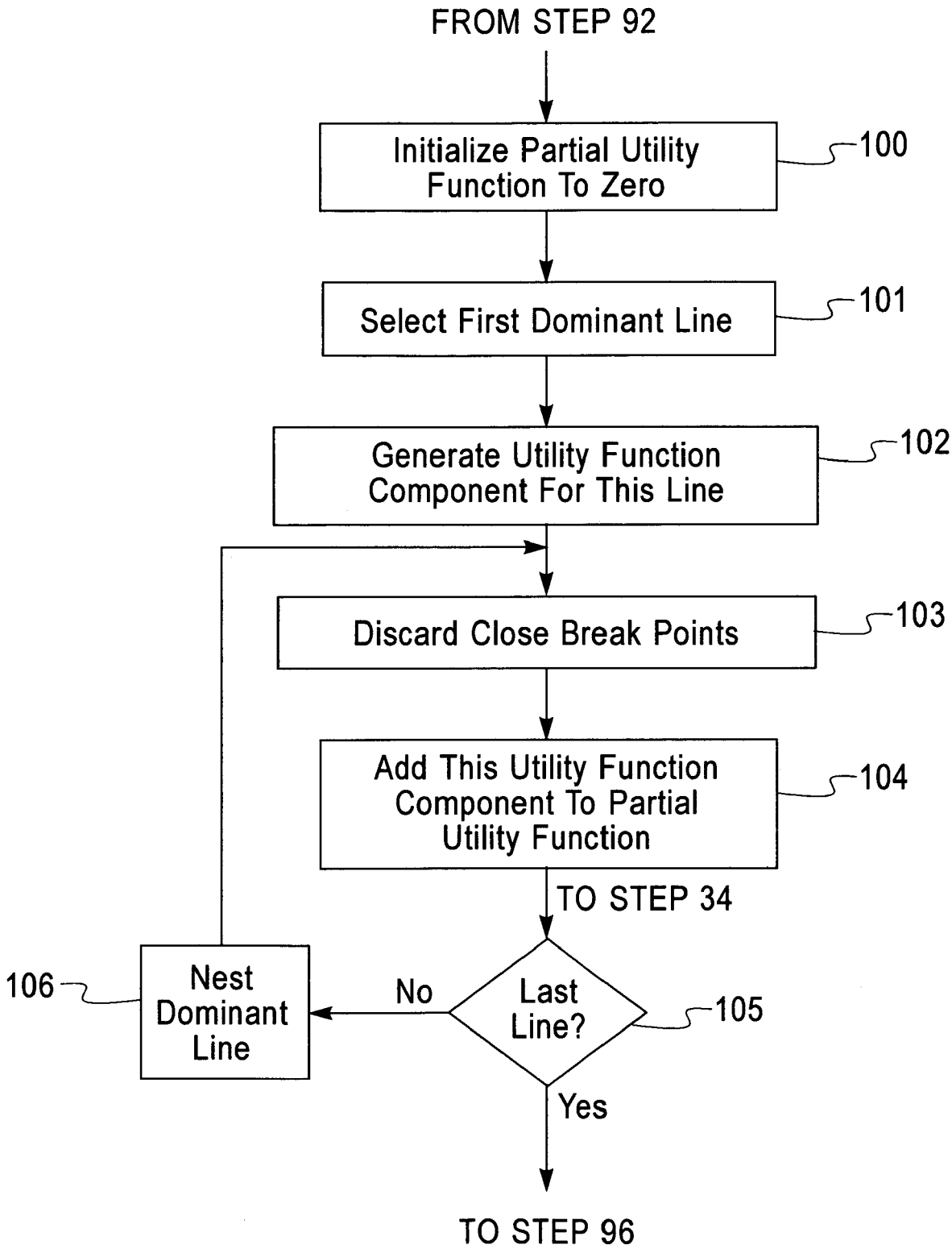

Continuing with FIG. 6B, the influence function c(f) is applied iteratively to each of the dominant lines ($b_{ij}$, $f_{ij}$) in the normalized line spectrum in order to generate the succession of partial utility functions $PU_j$. The process begins with the first component $U_{i1}(f_p)$. This component corresponds to the dominant spectral line ($b_{i1}$,$f_{i1}$). The value of $U_{i1}$(fp) is calculated at all of its break points over the range of search for $f_p$ at a utility function component generation step 102. The partial utility function $PU_1$ at this stage is simply equal to $U_{i1}$. In subsequent iterations at this step, the new component $U_{ij}(f_p)$ is determined both at its own break points and at all break points of the partial utility function $PU_{j-1}(f_p)$. The values of $U_{ij}(f_p)$ at the break points of $PU_{j-1}(f_p)$ are preferably calculated by interpolation. The values of $PU_{j-1}(f_p)$ are likewise calculated at the break points of $U_{ij}(f_p)$. If $U_{ij}(f_p)$ contains break points that are very close to existing break points in $PU_{j-1}$, these new break points are preferably discarded as superfluous at a discard step 103. Most preferably, break points whose frequency differs from that of an existing break point by no more than $0.0006*f_p^2$ are discarded in this manner. $U_{ij}$ is then added to $PU_{j-1}$ at all of the remaining break points, thus generating $PU_j$, at an addition step 104.

At a termination step 105, when the component $U_{iM}$ of the last dominant spectral line ($b_{iM}$,$f_{iM}$) has been evaluated, the process is complete, and the resultant utility function UD($f_p$) is passed to preliminary pitch candidates selection step 96. The function has the form of a set of frequency break points and the values of the preliminary utility function at the break points. Otherwise, if other dominant spectral lines remain to be evaluated, the next dominant line is taken at step 106, and the iterative process continues from step 102 until all dominant spectral lines have been evaluated.

It may be observed that the method of FIG. 6B searches all possible pitch frequencies in the search range, but it does so with optimized efficiency, since few spectral lines are involved, and the contribution of each line to the utility function is calculated only at specific break points, and not over the entire search range of pitch frequencies.

Figure 6C:
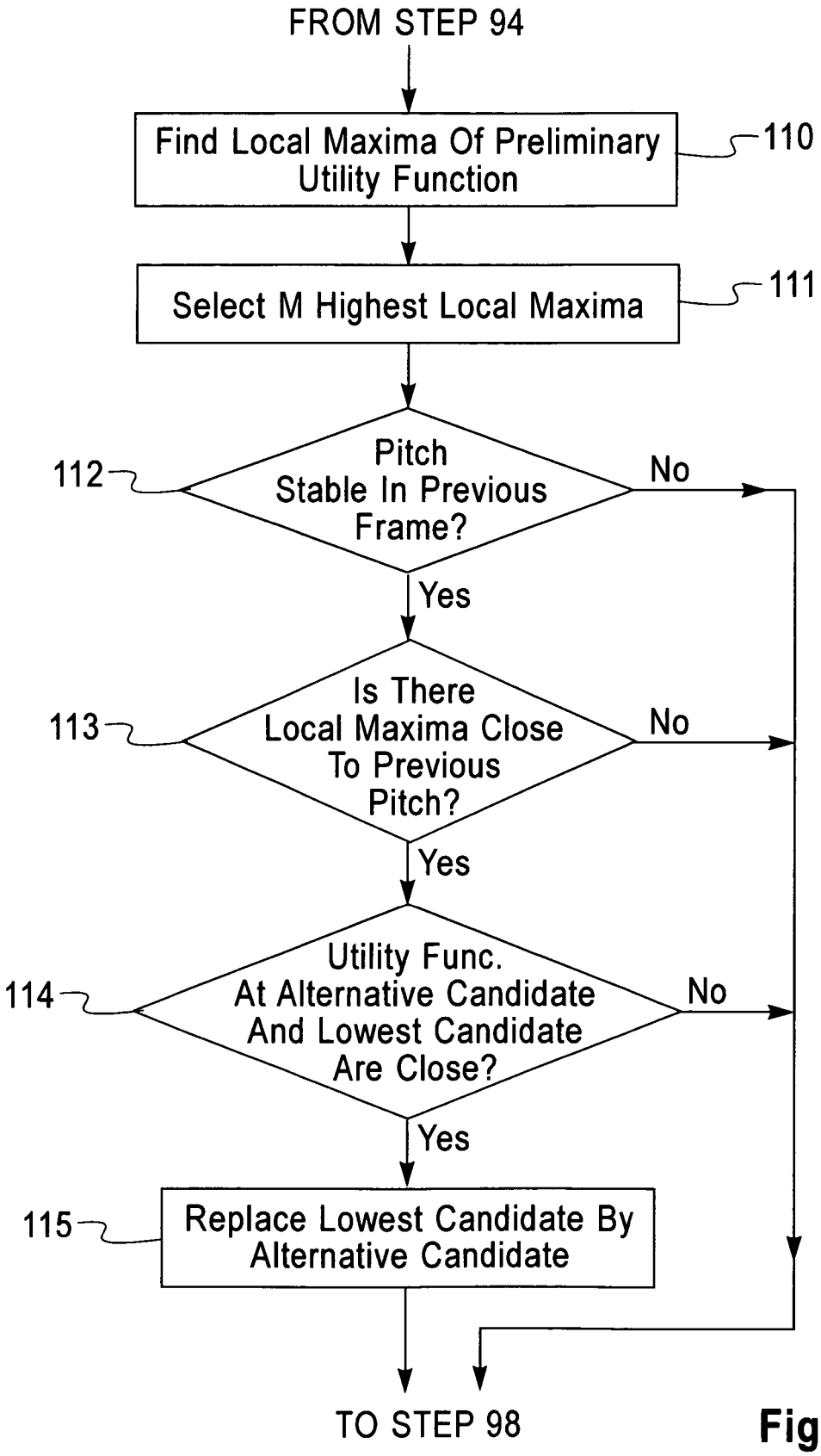

FIG. 6C is a flow chart that schematically illustrates details of preliminary pitch candidates selection step 96 (FIG. 6A) in accordance with a preferred embodiment of the present invention. A predefined number m of preliminary pitch candidates are selected. In a preferred embodiment of the present invention m is set to four. The selection of the preliminary pitch frequency candidates is based on the preliminary utility function output from step 94, including all break points that were found. The break points of the preliminary utility function are evaluated, and some are chosen as the preliminary pitch candidates.

At step 110, those break points that represent the local maxima of the preliminary utility function are found. Then m (typically four) highest local maxima are selected as the initial set {($f_1$, UD($f_1$)), ($f_2$, UD($f_2$)), . . . ,($f_m$, UD($f_m$))} of preliminary candidates. Let ($f_k$,UD($f_k$)) be the lowest member of the set, i.e., UD($f_k$)<UD($f_i$) if i≠k.

It is generally desirable to choose a pitch for the current frame that is near the pitch of the preceding frame, provided the pitch was stable in the preceding frame. Therefore, at a previous frame assessment step 112, it is determined whether the previous frame pitch was stable. Preferably, the pitch is considered to have been stable if over the six previous frames certain continuity criteria are satisfied. It may be required, for example, that the pitch change between consecutive frames was less than a predetermined value, such as 22%, and a predetermined value of the utility function was maintained in all of the frames. If the pitch has been stable, an alternative pitch frequency candidate $f_p^{alt}$ associated with the local maximum that is closest to the previous pitch frequency is selected at a nearest maximum selection step 113. Closeness between the alternative candidate frequency $f_p^{alt}$ and the previous pitch frequency $f_{prev}$ is then tested by evaluation of the condition:

$$1/R \leq f_p^{alt}/f_{prev} \leq R \quad \text{EQ. 11}$$

where R is set to a predetermined value, such as 1.22. If the condition is satisfied, the preliminary utility function at the alternative candidate frequency UD($f_p^{alt}$) is evaluated against the preliminary utility function of the lowest set member UD($f_k$) at a comparison step 114. If the values of the utility function at these two frequencies differ by no more than a predetermined threshold amount $T_1$, such as 0.06, then the lowest set member ($f_k$, UD($f_k$)) is replaced by ($f_p^{alt}$, UD($f_p^{alt}$)) at step 114. Otherwise, the initial set of preliminary candidates is kept unchanged. The initial set of preliminary candidates is likewise chosen if the pitch of the previous frame was found to be unstable at step 112, and if no local maximum was found in the vicinity of the previous pitch at step 113.

Figure 6D:
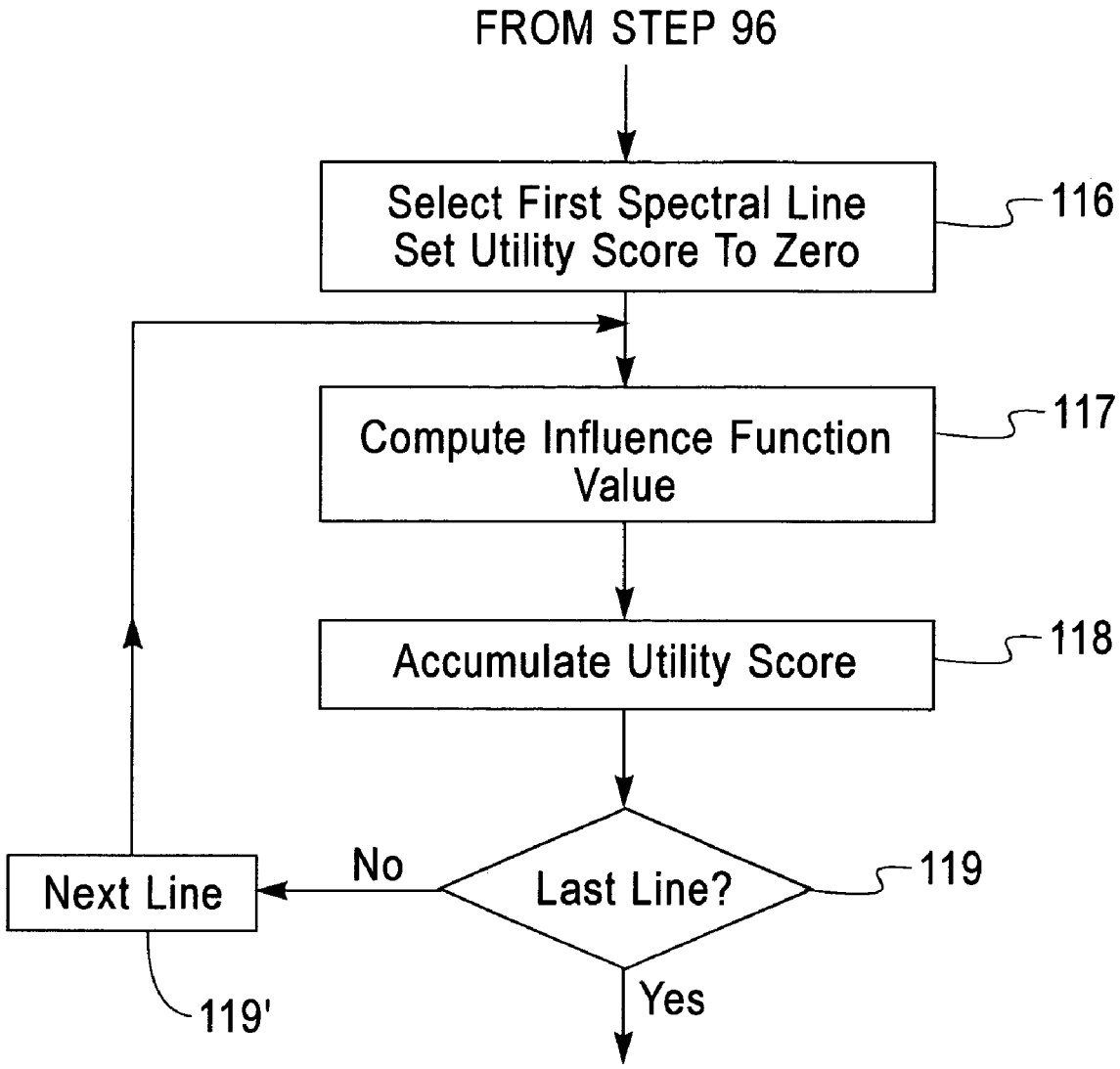

FIG. 6D is a flow chart that schematically illustrates details of computation step 98 (FIG. 6A) of the final utility scores associated with a preliminary pitch frequency candidate f. The sequence of steps shown on FIG. 6D is preferably applied to each preliminary candidate pitch frequency found at step 96. The final utility score is performed using EQ. 7 using all the spectral lines. At the initialization step 116 the score is set to zero and the first spectral line ($b_1$, $f_1$) is selected. A weighted influence function is computed using EQ. 6 at step 117. This includes computation of ratio $f_1/f$, taking the fractional part of the ratio in order to warp it to the main period cycle (−1, +1) of the influence function, applying EQ. 6 and multiplying by $b_1$. The obtained value is added to the score. The steps of FIG. 6D are preferably repeated for all the spectral lines.

Figure 9A:
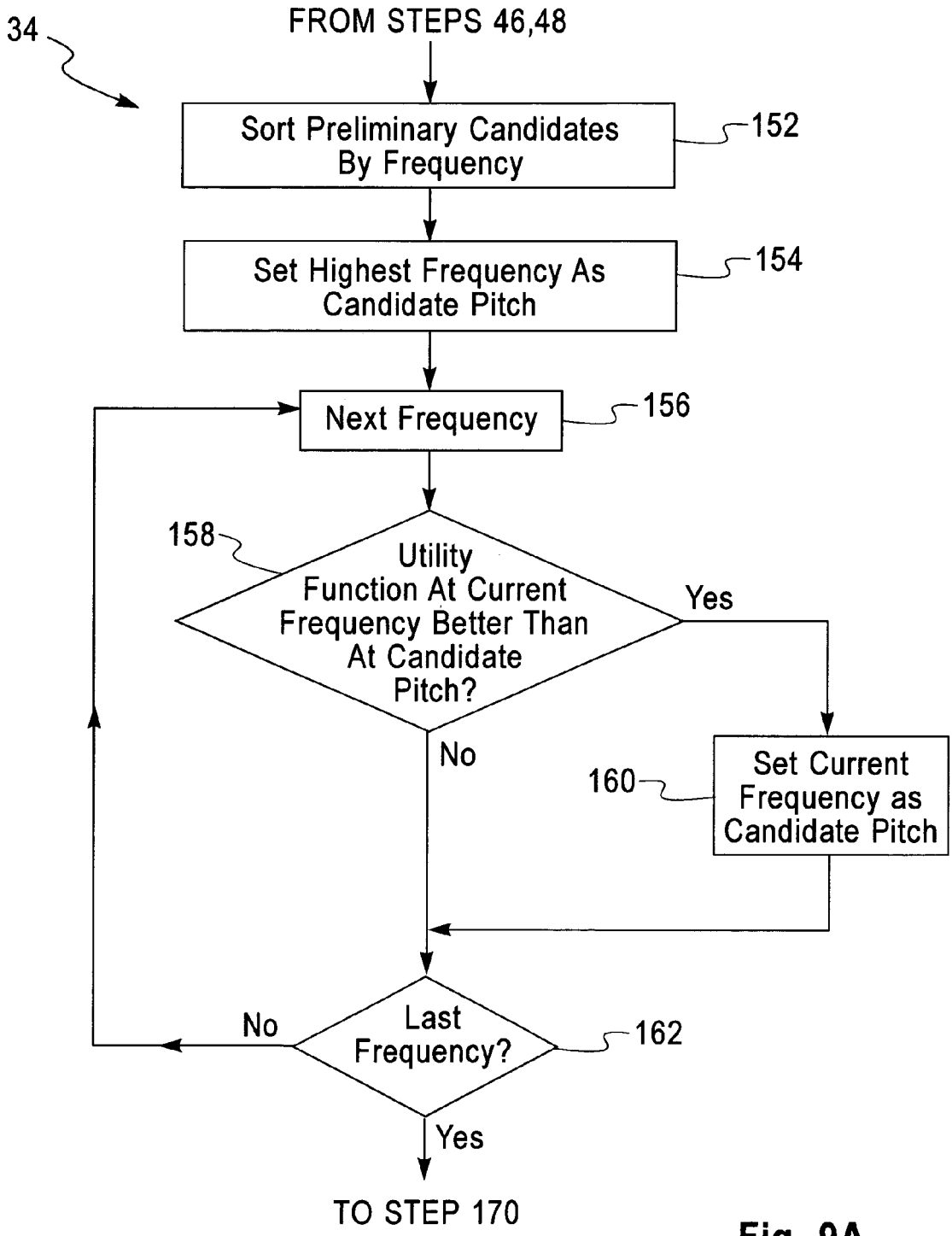
FIGS. 9A and 9B are flow charts that schematically illustrate a method for selecting an estimated pitch frequency for a frame of speech from among a plurality of candidate pitch frequencies, in accordance with a preferred embodiment of the present invention.
Figure 9B:
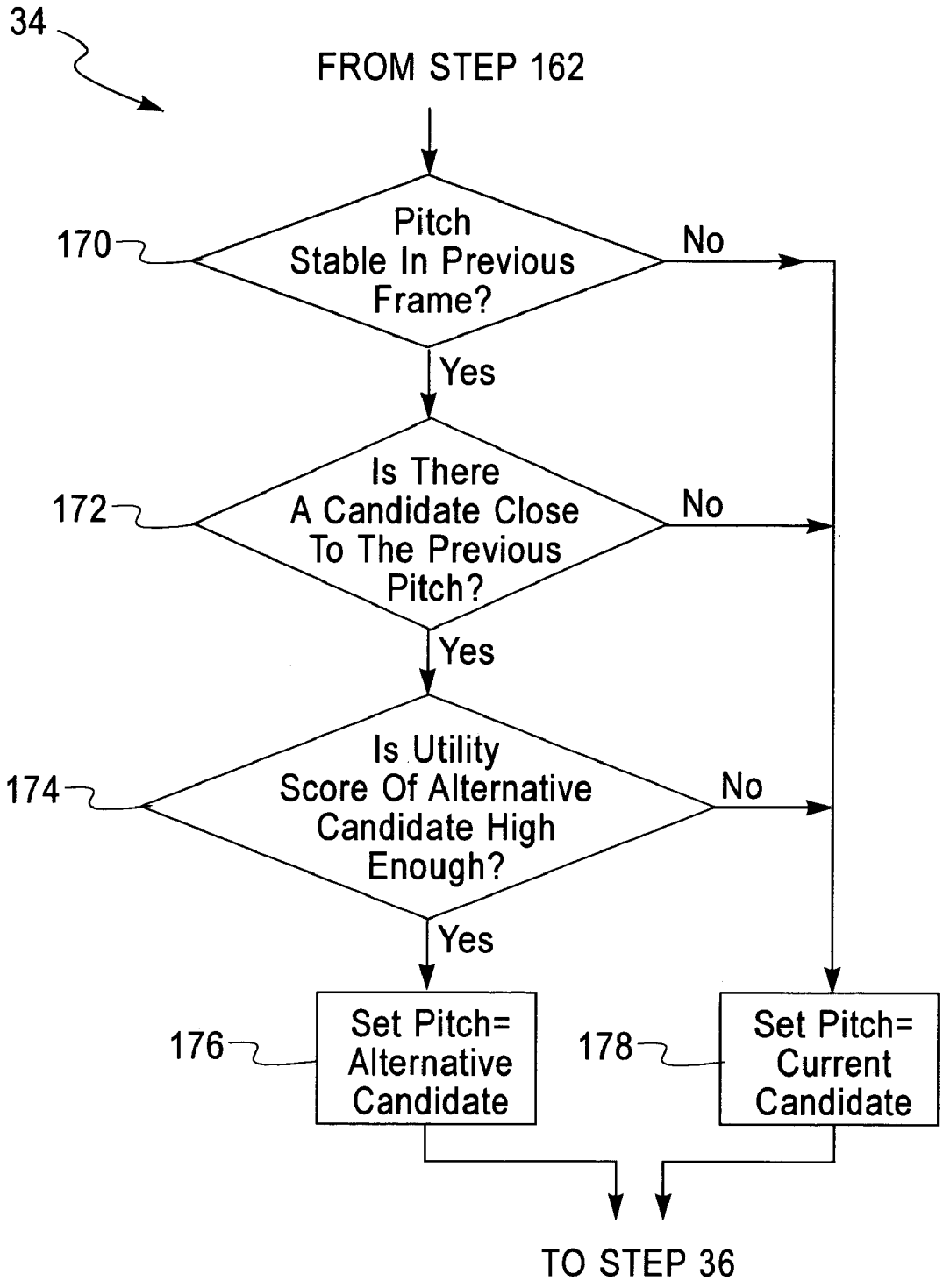

FIG. 9A and FIG. 9B are flow charts that illustrate details of the best pitch frequency selection step 34 (FIG. 2). The best pitch candidate is to be selected from among preliminary pitch candidates using their utility scores computed at step 98. Typically, preference is given to high pitch frequencies, in order to avoid mistaking integer dividends of the pitch frequency (corresponding to integer multiples of the pitch period) for the true pitch. Therefore, at a frequency sorting step 152, the preliminary candidates $\{f_p^i\}_{i=1}^m$ are sorted by frequency such that:

$$f_p^1 > f_p^2 > \ldots > f_p^m \quad \text{EQ. 12}$$

The estimated pitch $\hat{F}_0$ is preferably set initially to be equal to the highest-frequency candidate $f_p^1$ at an initialization step 154. Each of the remaining candidates is evaluated against the current value of the estimated pitch, in descending frequency order.

The process of evaluation begins at a next frequency step 156, with candidate pitch $f_p^2$. At an evaluation step 158, the value of the utility function, U($f_p^2$), is compared to U($\hat{F}_0$). If the utility function at $f_p^2$ is greater than the utility function at $\hat{F}_0$ by at least a threshold difference $T_2$, or if $f_p^2$ is near $\hat{F}_0$ and has a greater utility function, then $f_p^2$ is considered to be a superior pitch frequency estimate to the current $\hat{F}_0$. Preferably, $T_2$=0.06, and $f_p^2$ is considered to be near $\hat{F}_0$ if $1.17f_p^2>\hat{F}_0$. In this case, $\hat{F}_0$ is set to the new candidate value, $f_p^2$, at a candidate setting step 160. Steps 156 through 160 are repeated in turn for all of the preliminary candidates $f_p^i$, until the last frequency $f_p^m$ is reached, at a last frequency step 162.

It is generally desirable to choose a pitch for the current frame that is near the pitch of the preceding frame, provided the pitch was stable in the preceding frame. Therefore, in FIG. 9B, a process similar to the one used for preliminary candidates selection and shown on FIG. 6D may also be applied to the best pitch candidate selection. At a previous frame assessment step 170 it is determined whether the previous frame pitch has been stable as described above. If the pitch has been stable, the alternative pitch frequency $f_p^{alt}$ in the set $\{f_p^i\}$ that is closest to the previous pitch frequency is selected at step 172. The condition of EQ. 11 is then evaluated in order to determine if the alternative candidate is sufficiently close to the previous pitch frequency. If the condition is satisfied the utility function at this alternative frequency $U(f_p^{alt})$ is evaluated against the utility function of the current estimated pitch frequency $U(\hat{F}_0)$ at a comparison step 174. If the values of the utility function at these two frequencies differ by no more than a predetermined threshold amount $T_2$, then the alternative frequency $f_p^{alt}$ is chosen to be the estimated pitch frequency $\hat{F}_0$ for the current frame at step 176. Typically $T_2$ is set to be 0.06. Otherwise, if the values of the utility function differ by more than $T_2$, the current estimated pitch frequency $\hat{F}_0$ from step 162 remains the chosen pitch frequency for the current frame, at a candidate frequency setting step 178. This estimated value is likewise chosen if the pitch of the previous frame was found to be unstable at step 170, and if no preliminary candidate was found in the vicinity of the previous pitch at the step 172.

Figure 10:
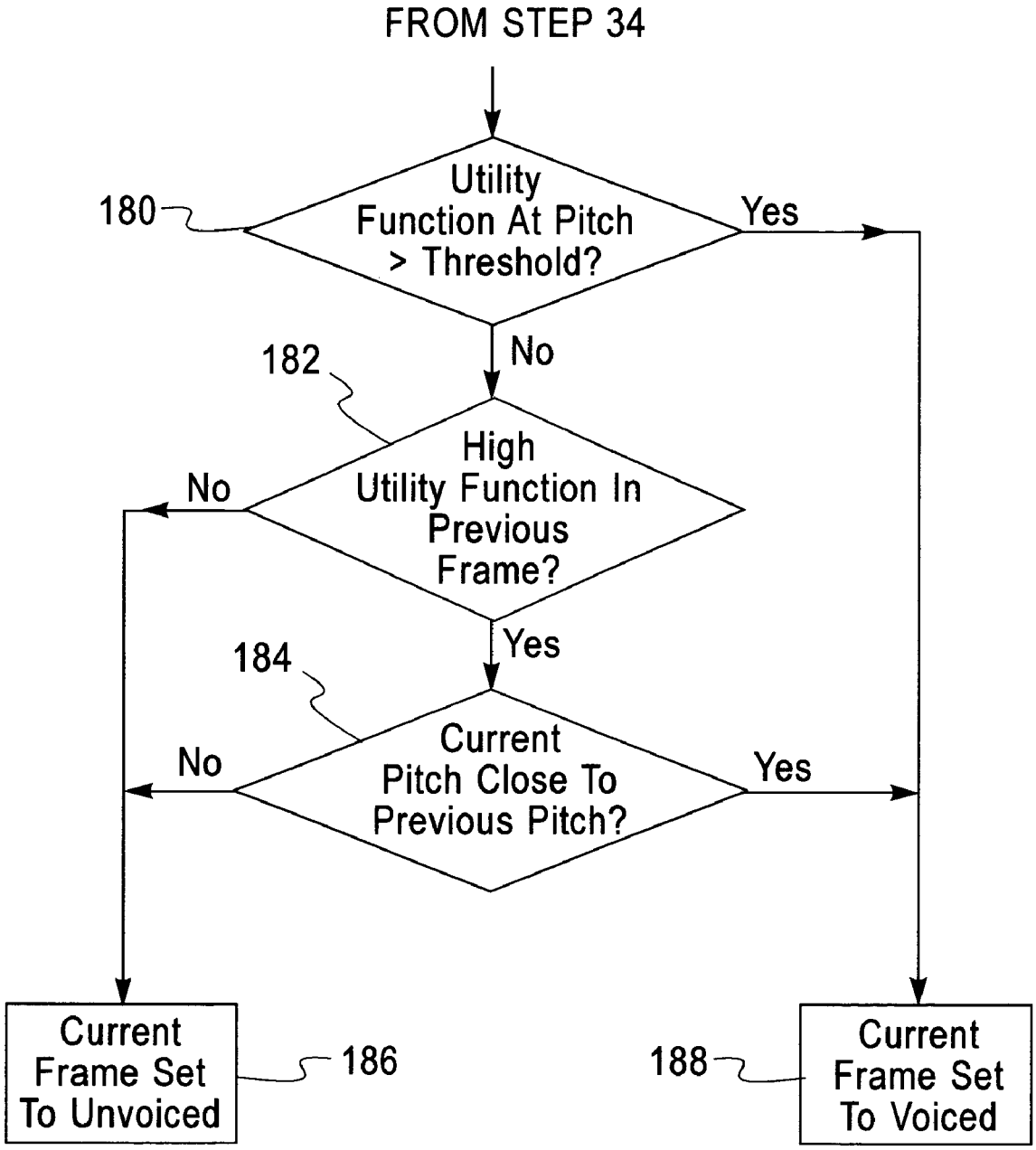
FIG. 10 is a flow chart that schematically illustrates a method for determining whether a frame of speech is voiced or unvoiced, in accordance with a preferred embodiment of the present invention.

FIG. 10 is a flow chart that schematically shows details of voicing decision step 36, in accordance with a preferred embodiment of the present invention. The decision is based on comparing the utility function at the estimated pitch, $U(\hat{F}_0)$, to the above-mentioned threshold $T_{uv}$, at a threshold comparison step 180. Typically, $T_{uv}$=0.75. If the utility function is above the threshold, the current frame is classified as voiced, at a voiced setting step 188.

During transitions in a speech stream, however, the periodic structure of the speech signal may change, leading at times to a low value of the utility function even when the current frame should be considered voiced. Therefore, when the utility function for the current frame is below the threshold $T_{uv}$, the utility function of the previous frame is checked, at a previous frame checking step 182. If the estimated pitch of the previous frame had a high utility value, typically at least 0.84, and the pitch of the current frame is found, at a pitch checking step 184, to be close to the pitch of the previous frame, typically differing by no more than 18%, then the current frame is classified as voiced, at step 188, despite its low utility value. Otherwise, the current frame is classified as unvoiced, at an unvoiced setting step 186.

It is appreciated that one or more of the steps of any of the methods described herein may be omitted or carried out in a different order than that shown, without departing from the true spirit and scope of the invention.

While the methods and apparatus disclosed herein may or may not have been described with reference to specific computer hardware or software, it is appreciated that the methods and apparatus described herein may be readily implemented in computer hardware or software using conventional techniques.

It will be appreciated that the preferred embodiments described above are cited by way of example, and that the present invention is not limited to what has been particularly shown and described hereinabove. Rather, the true spirit and scope of the present invention includes both combinations and subcombinations of the various variations and modifications thereof which upon reading the foregoing description and

What is claimed is:

1. A method for estimating a pitch frequency of a speech signal, comprising:

determining a line spectrum of a frame of a speech signal, the spectrum comprising a plurality of spectral lines having respective line amplitudes and line frequencies;

selecting a predefined number of said spectral lines having the highest amplitudes among said spectral lines, wherein the number of selected spectral lines is less then the total number of said plurality of spectral lines;

calculating a preliminary utility function over a pitch frequency range using said selected spectral lines from among said plurality of spectral lines, thereby providing a preliminary utility function value for each pitch frequency in said range that is a measure of a compatibility of said selected spectral lines with said pitch frequency;

identifying a predefined number of preliminary pitch frequency candidates at least partly responsive to said preliminary utility function, wherein each preliminary pitch frequency candidate is a local maximum of said preliminary utility function;

calculating a final utility score for each of said preliminary pitch frequency candidates using all of said plurality of spectral lines; and selecting any of said plurality of preliminary pitch frequency candidates to be an estimated pitch frequency of said speech signal at least partly responsive to any of said final utility scores.

2. A method according to claim 1 wherein said calculating a preliminary utility function step comprises:

computing an influence function respective to each of said selected spectral lines, wherein said influence function is periodic in a ratio of the frequency of said spectral line to any pitch frequency; and computing a superposition of said influence functions.

3. A method according to claim 2, wherein said computing an influence function step comprises computing a function of said ratio having maxima at integer values of said ratio and minima therebetween.

4. A method according to claim 3, wherein said computing an influence function step comprises computing values of a piecewise linear function c(f), having a maximum value in a first interval surrounding f=0, a minimum value in a second interval surrounding f=½, and a value that varies piecewise linearly in a transition interval between the first and second intervals.

5. A method according to claim 2, wherein said influence functions are piecewise linear functions, and wherein said computing a superposition step comprises calculating values of said influence functions at their break points such that said preliminary utility function is determined by interpolation between said break points.

6. A method according to claim 5, wherein said computing said influence function step comprises computing at least first and second influence functions for first and second spectral lines from among said selected spectral lines in succession, and wherein said computing a preliminary utility function step comprises:

computing a partial utility function including said first influence function; and adding said second influence function to said preliminary utility function by calculating the values of said second influence function at the break points of said preliminary utility function and calculating the values of said preliminary utility function at the break points of said second influence function.

7. A method according to claim 6, wherein said determining a pitch frequency candidate step comprises preferentially selecting a local maximum of said preliminary utility function that is near in frequency to a previously-estimated pitch frequency of a preceding frame of said speech signal.

8. A method according to claim 1, wherein said calculating a final utility score step comprises:

computing an influence function respective to each of said spectral lines, wherein said influence function is periodic in a ratio of the frequency of said spectral line to any pitch frequency; and computing a sum of said influence functions.

9. A method according to claim 8, wherein said computing an influence function step comprises computing a function of said ratio having maxima at integer values of said ratio and minima therebetween.

10. A method according to claim 9, wherein said computing the function of said ratio step comprises computing values of a piecewise linear function c(f), having a maximum value in a first interval surrounding f=0, a minimum value in a second interval surrounding f=½, and a value that varies piecewise linearly in a transition interval between the first and second intervals.

11. A method according to claim 1 wherein said selecting a pitch frequency step comprises preferentially selecting one of said preliminary pitch frequency candidates that has a higher final utility score than another one of said preliminary pitch frequency candidates.

12. A method according to claim 1, wherein said selecting a pitch frequency step comprises preferentially selecting one of said preliminary pitch frequency candidates that has a higher frequency than another one of said preliminary pitch frequency candidates.

13. A method according to claim 1, wherein said selecting a pitch frequency step comprises preferentially selecting one of said preliminary pitch frequency candidates that is near in frequency to a previously-estimated pitch frequency of a preceding frame of said speech signal.

14. A method according to claim 1, and further comprising determining whether said speech signal is voiced or unvoiced by comparing said final utility score of said estimated pitch frequency to a predetermined threshold.

15. A method according to claim 1, and further comprising encoding said speech signal responsive to said estimated pitch frequency.

16. Apparatus for estimating a pitch frequency of a speech signal, comprising:

means for determining a line spectrum of a frame of a speech signal, the spectrum comprising a plurality of spectral lines having respective line amplitudes and line frequencies;

means for selecting a predefined number of said spectral lines having the highest amplitudes among said spectral lines, wherein the number of selected spectral lines is less then the total number of said plurality of spectral lines;

means for calculating a preliminary utility function over a pitch frequency range using said selected spectral lines from among said plurality of spectral lines, thereby providing a preliminary utility function value for each pitch frequency in said range that is a measure of a compatibility of said selected spectral lines with said pitch frequency;

means for identifying a predefined number of preliminary pitch frequency candidates at least partly responsive to said preliminary utility function, wherein each preliminary pitch frequency candidate is a local maximum of said preliminary utility function;

means for calculating a final utility score for each of said preliminary pitch frequency candidates using all of said plurality of spectral lines; and means for selecting any of said plurality of preliminary pitch frequency candidates to be an estimated pitch frequency of said speech signal at least partly responsive to any of said final utility scores.

17. Apparatus according to claim 16 wherein said means for calculating a preliminary utility function is operative to:

compute an influence function respective to each of said selected spectral lines, wherein said influence function is periodic in a ratio of the frequency of said spectral line to any pitch frequency; and compute a superposition of said influence functions.

18. Apparatus according to claim 17, wherein said means for computing an influence function is operative to compute a function of said ratio having maxima at integer values of said ratio and minima therebetween.

19. Apparatus according to claim 18, wherein said means for computing an influence function is operative to compute values of a piecewise linear function c(f), having a maximum value in a first interval surrounding f=0, a minimum value in a second interval surrounding f=½, and a value that varies piecewise linearly in a transition interval between the first and second intervals.

20. Apparatus according to claim 17, wherein said influence functions are piecewise linear functions, and wherein said means for computing a superposition is operative to calculating values of said influence functions at their break points such that said preliminary utility function is determined by interpolation between said break points.

21. Apparatus according to claim 20, wherein said means for computing said influence function is operative to compute at least first and second influence functions for first and second spectral lines from among said selected spectral lines in succession, and wherein said means for computing a preliminary utility function is operative to:

compute a partial utility function including said first influence function; and add said second influence function to said preliminary utility function by calculating the values of said second influence function at the break points of said preliminary utility function and calculating the values of said preliminary utility function at the break points of said second influence function.

22. Apparatus according to claim 21, wherein said means for determining a pitch frequency candidate is operative to preferentially select a local maximum of said preliminary utility function that is near in frequency to a previously-estimated pitch frequency of a preceding frame of said speech signal.

23. Apparatus according to claim 16, wherein said means for calculating a final utility score is operative to:

compute an influence function respective to each of said spectral lines, wherein said influence function is periodic in a ratio of the frequency of said spectral line to any pitch frequency; and compute a sum of said influence functions.

24. Apparatus according to claim 23, wherein said means for computing an influence function is operative to compute a function of said ratio having maxima at integer values of said ratio and minima therebetween.

25. Apparatus according to claim 24, wherein said means for computing the function of said ratio is operative to compute values of a piecewise linear function c(f), having a maximum value in a first interval surrounding f=0, a minimum value in a second interval surrounding f=½, and a value that varies piecewise linearly in a transition interval between the first and second intervals.

26. Apparatus according to claim 16 wherein said means for selecting a pitch frequency is operative to preferentially select one of said preliminary pitch frequency candidates that has a higher final utility score than another one of said preliminary pitch frequency candidates.

27. Apparatus according to claim 16, wherein said means for selecting a pitch frequency is operative to preferentially select one of said preliminary pitch frequency candidates that has a higher frequency than another one of said preliminary pitch frequency candidates.

28. Apparatus according to claim 16, wherein said means for selecting a pitch frequency is operative to preferentially select one of said preliminary pitch frequency candidates that is near in frequency to a previously-estimated pitch frequency of a preceding frame of said speech signal.

29. Apparatus according to claim 16, and further comprising means for determining whether said speech signal is voiced or unvoiced by comparing said final utility score of said estimated pitch frequency to a predetermined threshold.

30. Apparatus according to claim 16, and further comprising means for encoding said speech signal responsive to said estimated pitch frequency.

31. A computer program embodied on a computer-readable medium, the computer program comprising:

a first code segment operative to determine a line spectrum of a frame of a speech signal, the spectrum comprising a plurality of spectral lines having respective line amplitudes and line frequencies;

a second code segment operative to select a predefined number of said spectral lines having the highest amplitudes among said spectral lines, wherein the number of selected spectral lines is less then the total number of said plurality of spectral lines;

a third code segment operative to calculate a preliminary utility function over a pitch frequency range using said selected spectral lines from among said plurality of spectral lines, thereby providing a preliminary utility function value for each pitch frequency in said range that is a measure of a compatibility of said selected spectral lines with said pitch frequency;

a fourth code segment operative to identify a predefined number of preliminary pitch frequency candidates at least partly responsive to said preliminary utility function, wherein each preliminary pitch frequency candidate is a local maximum of said preliminary utility function;

a fifth code segment operative to calculate a final utility score for each of said preliminary pitch frequency candidates using all of said plurality of spectral lines; and a sixth code segment operative to select any of said plurality of preliminary pitch frequency candidates to be an estimated pitch frequency of said speech signal at least partly responsive to any of said final utility scores.

* * * * *